US006768477B2

(12) United States Patent
Beuker et al.

(10) Patent No.: US 6,768,477 B2
(45) Date of Patent: Jul. 27, 2004

(54) MATRIX DISPLAY DEVICE WITH REDUCED LOSS OF RESOLUTION

(75) Inventors: Rob Anne Beuker, Eindhoven (NL); Hendrikus Hermanus Antonius Andreas Van Den Berg, Eindhoven (NL); Geert Nijholt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1 day.

(21) Appl. No.: 09/942,002

(22) Filed: Aug. 29, 2001

(65) Prior Publication Data

US 2003/0071831 A1 Apr. 17, 2003

(30) Foreign Application Priority Data

Aug. 30, 2000 (EP) ..... 00203018

(51) Int. Cl.[7] ..... G09G 3/20
(52) U.S. Cl. ..... 345/55; 345/690
(58) Field of Search ..... 345/55, 87, 89, 345/60, 63, 204, 690–693, 616; 348/671, 687

(56) References Cited

U.S. PATENT DOCUMENTS 5,760,756 A * 6/1998 Kobayashi et al. ..... 345/87
5,917,471 A * 6/1999 Choi ..... 345/690
5,953,002 A * 9/1999 Hirai et al. ..... 345/204
6,313,817 B2 * 11/2001 Kuijk ..... 345/87
6,362,834 B2 * 3/2002 Ishii ..... 345/690
6,388,678 B1 * 5/2002 Kasahara et al. ..... 345/690
6,476,824 B1 * 11/2002 Suzuki et al. ..... 345/690
6,556,214 B1 * 4/2003 Yamada et al. ..... 345/616
6,590,571 B2 * 7/2003 Laffargue et al. ..... 345/204

* cited by examiner

*Primary Examiner*—Richard Hjerpe
*Assistant Examiner*—Francis Nguyen
(74) *Attorney, Agent, or Firm*—Michael J. Ure

(57) ABSTRACT

Matrix display device (1) wherein multiple line addressing is performed by a unit (LD). As a consequence of the multiple line addressing, there is a difference between the luminance values actually displayed (C) and the original luminance values (D). The visible effects of said difference or error (E) are minimized by subtracting said difference or part thereof from the original luminance values, either from neighbouring pixels to be displayed and/or from the same pixels of the subsequent frame. Said neighbouring pixels are preferably the pixels directly below or to the right of the ones considered. The latter is obtained by applying a sample delay to the error (E).

12 Claims, 3 Drawing Sheets

MATRIX DISPLAY DEVICE WITH REDUCED LOSS OF RESOLUTION

FIELD OF THE INVENTION

The invention relates to a matrix display device for displaying luminance values, wherein a common value is determined for a group of lines and addressed simultaneously to said group of lines. This is performed, for example, when said luminance values are coded in subfields and some of the least significant subfields are replaced by a common value.

The invention also relates to a method of determining new luminance values based on original luminance values to be displayed on a matrix display device.

The invention is applicable in, for example, to plasma display panels (PDPs), plasma-addressed liquid crystal panels (PALCs), liquid crystal displays (LCDs), Polymer LEDs (PLEDs), Electroluminescent (EL), Digital Micromirror Devices (DMDs), used for personal computers, television sets and so forth.

BACKGROUND OF THE INVENTION

A matrix display device comprises a first set of data lines (rows) $r_1 \ldots r_M$ extending in a first direction, usually called the row direction, and a second set of data lines (columns) $c_1 \ldots c_N$ extending in a second direction, usually called the column direction, intersecting the first set of data lines, each intersection defining a pixel (dot).

A matrix display device furthermore comprises means for receiving an information signal comprising information on the luminance values of lines to be displayed and means for addressing the first set of data lines (rows) $r_1, \ldots r_N$ in dependence on the information signal. Luminance values are hereinafter understood to be the grey level in case of monochrome displays, and each of the individual levels in colour (e.g. RGB) displays.

Such a display device may display a frame by addressing the first set of data lines (rows) line by line, each line (row) successively receiving the appropriate data to be displayed.

In order to reduce the time necessary for displaying a frame, a multiple line addressing method may be applied. In this method, more than one, usually two, neighbouring, and preferably adjacent lines of the first set of data lines (rows) are simultaneously addressed, receiving the same data.

This so-called double line addressing method (when two lines are simultaneously addressed) effectively allows speed-up of the display of a frame, because each frame requires less data, but this is at the expense of a loss of the picture quality with respect to the original signal, because each pair of lines receives the same data, which induces a loss of resolution and/or of sharpness due to the duplication of the lines.

These known methods allow a reduction of the addressing time. However, there may be a difference, and in some instances a large difference, between the original luminance values to be displayed and the new luminance values actually displayed. This difference, induced by the line doubling or grouping, herein called "error", causes a loss in spatial resolution, and increases visible noise-like artifacts, comparable to quantization.

For the above-mentioned matrix display panel types, the generation of light cannot be modulated in intensity to create different grey scale levels, as it is the case for CRT displays. On said matrix display panel types, grey levels are created by modulating in time: for higher intensities, the duration of the light emission period is increased. The luminance data are coded in a set of subfields, each having an appropriate duration or weight for displaying a range of light intensities between a zero and a maximum level. The relative weight of the subfields may be binary (i.e. 1, 2, 4, 8, . . . ) or not. This subfield decomposition, described here for grey scales, will also apply hereinafter to the individual colours of a colour display. Line doubling or grouping is particularly useful in display panels using subfields, in order to reduce the addressing time.

In order to reduce loss of resolution, partial line doubling, i.e. line doubling for only some less significant subfields (hereinafter referred to as LSB subfields), can be performed. Indeed, the LSB subfields correspond to a less important amount of light, and partial line doubling will give less visible loss in resolution.

When more than two lines are addressed simultaneously for some less significant subfields, partial line grouping is performed. Considerations about partial line doubling will hereinafter also apply, mutatis mutandis, to partial line grouping of more than two lines.

In performing the partial line doubling method, a compromise must be sought. Only a few LSB subfields doubled would give a little gain of time. Too many subfields doubled would give an unacceptable loss of picture quality.

Another aspect that influences the quality is the method of calculating the new data of doubled subfields. Different calculation methods giving different results can be used. The method used should give the best picture quality, as seen by the observer's eyes.

As the LSBs are doubled in partial line doubling, the value of the LSB data for two neighbouring or adjacent lines must be the same. The following methods may be used for the calculation of these data:

1. The LSB data of odd lines is used on the adjacent even lines (simple copy of bits).
2. The LSB data of even lines is used on the neighbouring or adjacent odd lines (simple copy of bits).
3. The average LSB data of each pair of pixels is used for both new LSB values.

SUMMARY OF THE INVENTION

It is an object of the invention to provide a matrix display device with line doubling or grouping, and a method of calculating new data to be displayed on said matrix display device where loss of resolution and/or visibility of noise-like artifacts is reduced, and preferably minimised.

To this end, a first aspect of the invention provides a matrix display device as defined in claim 1, providing a diffusion of the error induced by the line doubling or grouping either to neighbouring pixels to be displayed in the current frame and/or to neighbouring pixels of a subsequent frame. The visible error induced by line doubling or grouping is thereby reduced. Dependent claims 2 to 4 provide a specific diffusion of the error to the right-hand pair or group of pixels, the pair or group of pixels immediately below the one considered, and the same pair or group of pixels in the subsequent frame, respectively. Diffusing the error to the right-hand pair or group of pixels diffuses the error to the nearest pixels.

Simple embodiments, requiring a small number of components when implemented in hardware, are the subjects of depenent claims 2 to 4.

Dependent claim 2 relates to diffusion of the error to one or more neighbouring pixels on the same line.

Dependent claim 3 relates to diffusion of the error to one or more neighbouring pixels in a subsequent pair or subsequent pairs of lines.

Dependent claim 4 relates to temporal diffusion of the error to the same or neighbouring pixels.

Claim 5 relates to the case where luminance values are coded in subfields.

A second aspect of the invention provides a method as defined in claim 7. Dependent method claims 8 to 12 correspond to device claims 2 to 7, respectively.

These and other aspects of the invention are apparent from and will be elucidated with reference to the embodiment(s) described hereinafter with reference to the accompanying drawings.

DETAILED DESCRIPTION OF A PREFERRED EMBODIMENT

Figure 1:
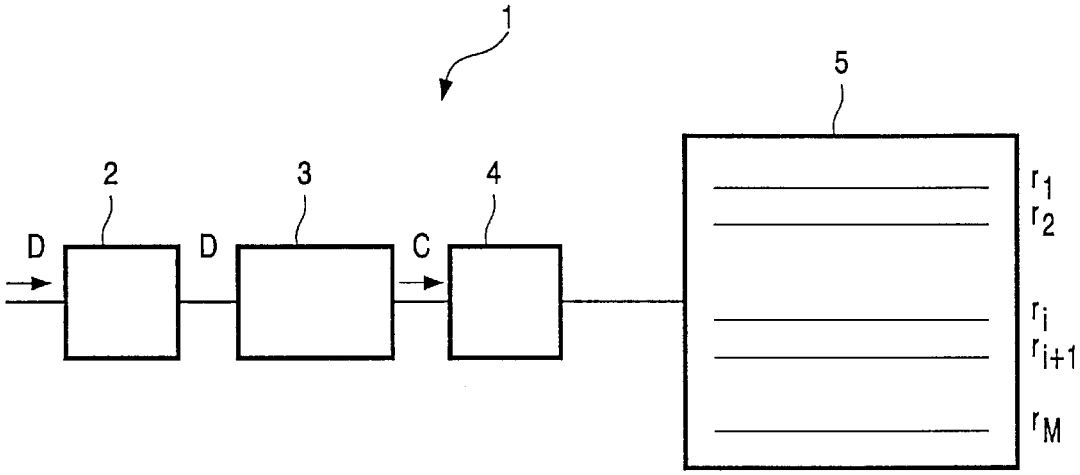
FIG. 1 schematically shows a matrix display device according to the invention.

FIG. 1 is a schematic diagram of a matrix display device 1 comprising a matrix display panel 5, showing a set of display lines (usually directed in the row direction and in this case called rows) $r_1, r_2, \ldots r_i, r_{i+1}, \ldots r_M$. The matrix display panel 5 further comprises a set of data lines (columns, not shown) extending in a second direction usually being the column direction, intersecting the first set of data lines, each intersection defining a pixel (dot, not shown).

The matrix display furthermore comprises a circuit 2 for receiving an information signal D comprising information on the luminance of lines to be displayed and a driver circuit 4 for addressing the set of data lines (rows $r_1, \ldots r_M$) in dependence on the information signal D which signal comprises original pixel luminance values $d_{11}, \ldots d_{ij} \ldots d_{MN}$.

The display device 1 in accordance with the invention comprises a unit 3 for determining new pixel luminance values $c_{11}, \ldots c_{ij} \ldots c_{MN}$ of pixels, shown as C in FIG. 1, on the basis of original pixel luminance values $d_{11}, \ldots d_{ij} \ldots d_{MN}$ using any line doubling or grouping method.

Detailed views of unit 3, shown in FIGS. 2 to 5, show a 'LD' block, a line grouping circuit performing the line doubling or grouping algorithm, in accordance with one of different methods, wherein a new common value for groups of adjacent or neighbouring lines is determined. In displays where subfields are used, this may be performed for only some least significant subfields.

Unit 3 comprises a subtractor 10 which subtracts a correction value signal E' supplied by processor unit 11 from the original line luminance values $d_{11}, \ldots d_{ij} \ldots d_{MN}$ to supply difference values DF ($df_{11}, \ldots df_{ij} \ldots df_{MN}$) to the line grouping circuit LD. The line grouping means may be constituted by or comprise any hardware (such as a circuit shown in FIG. 3 or an arrangement of circuits, forming a line-grouping circuit) or software (such as a computer program or part of a computer program in a microprocessor), which may be specifically incorporated for this function or may be a multi-purpose microprocessor with which more functions are performed, thus forming a piece of software to perform the line doubling function). If a signal E is zero the original line luminance value and the difference value are of course one and the same. An error-determining unit 12 determines the error between the difference line luminance values DF and the new line luminance value C. This error signal E is converted into a correction value signal E' in processor unit 11.

According to the present invention, the following operations A thru C are performed by unit 3:

A: The differences $e_{ij}$ and $e_{i+1,j}$ between the line-doubling computed pixel luminance values $c_{ij}$, $c_{i+1,j}$, and the difference pixel luminance values, $df_{ij}$, $df_{i+1,j}$ of pixels ij and i+1,j are computed:

$$e_{ij}=c_{ij}-df_{ij}$$

$$e_{i+1,j}=c_{i+1,j}-df_{i+1,j}$$

In FIGS. 2 to 5, said method step is depicted by error determining unit 12 and the signals going into and out of this unit 12. These differences are a measure of the excess of the luminance $C_{ij}$ effectively shown with respect to the original luminance $df_{ij}$, i.e. of the error introduced by line doubling. The set of differences constitutes the error signal E. This error signal is shown as E in FIGS. 2 to 5. In formula this can be denoted as E=C−DF B: The error E, or part thereof, is diffused, or subtracted from neighbouring pixels and/or to the same pixels of subsequent frames. To this end, the error signal E is converted in processor unit 11 into a correction value signal E', which is actually a set of correction values. In formula, E'=conversion of E.

C: Finally E' is subtracted in subtractor 10 from D to give DF. In formula, DF=D−E'

Figure 2:
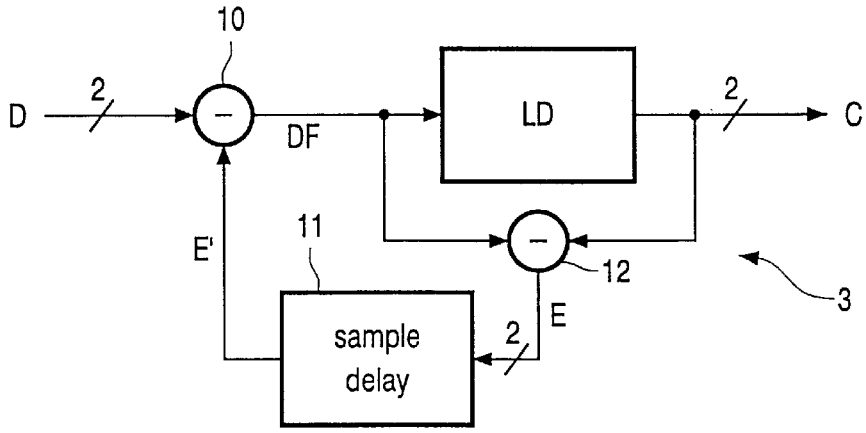
FIG. 2 is a detailed view of unit (3) of the invention, according to a first embodiment of the invention.

Methods of diffusing the errors are AA thru DD as listed below:

AA: horizontal feedback (sample delay), as shown in FIG. 2: the error E, or part thereof, is subtracted from the original luminance values $d_{i,j+1}$, $d_{i+1,j+1}$ of the pixels located on the same pair of lines, on the next column j+1, one step further to the right:

$$df_{i,j+1}:=d_{i,j+1}-F_h{}^*e_{i,j}$$

$$df_{i+1,j+1}:=d_{i+1,j+1}-F'_h{}^*e_{i+1,j}$$

In this example, the correction value signal E' is constituted by the set of signals $F_h{}^*e_{i,j}$;$F'_h{}^*e_{i+1,j}$, etc. to be subtracted from $d_{i,j+1}$; $d_{i+1,j+1}$, etc. The coefficients F, F' determine the transfer or diffusion of the error to neighbouring pixels.

FIG. 2 shows a unit 3 for performing horizontal feedback. This is a simple embodiment of the invention, requiring a small number of components when implemented in hardware. As the error is diffused to the nearest possible pixels, the visual effect of line doubling is significantly reduced.

The error is preferably further diffused by subtracting a part of the error from the next nearest neighbouring pixel, a smaller part from the next nearest neighbouring pixel, etc. i.e.

$$df_{i,j+1}:=d_{i,j+1}-F_h*e_{i,j}-F''_h*e_{i-1,j}$$

$$df_{i+1,j+1}:=d_{i+1,j+1}-F'_h*e_{i+1,j}-F'''_h*e_{i,j}$$

The coefficients F, F', F'', F''' determine the amount of diffusion of the errors over neighbouring and next-neighbouring pixels.

Figure 3:
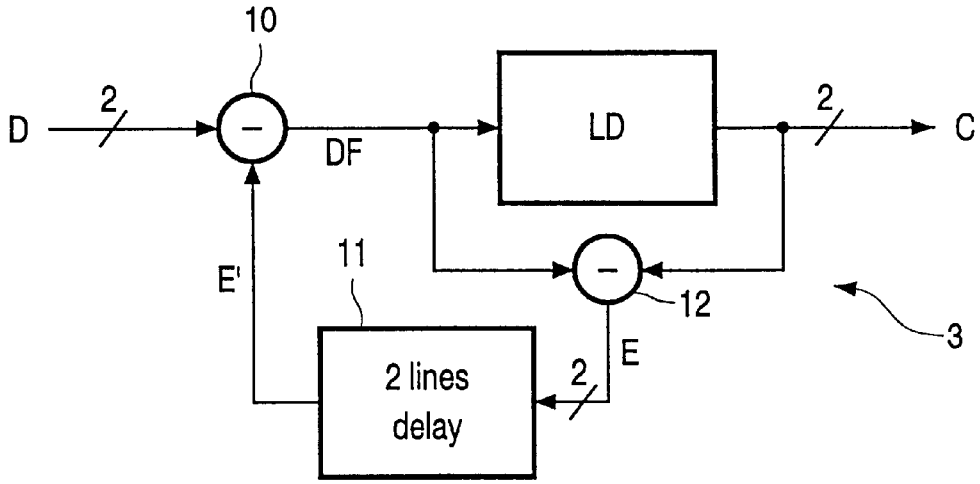
FIG. 3 is a detailed view of unit (3) of the invention, according to a second embodiment of the invention.

BB: vertical feedback (2 lines delay), as shown in FIG. 3: the error, or part thereof, is subtracted from the original pixel luminance values $d_{i+3j}$, $d_{i+4,j}$ of the pixels located on a pair of lines, two steps further below, and on the same columns j:

$$df_{i+2,j}:=d_{i+2,j}-F_v*e_{i,j}$$

$$df_{i+3,j}:=d_{i+3,j}-F'_v*e_{i+1,j}$$

FIG. 3 shows a unit 3 for performing vertical feedback. This simple embodiment of the invention also requires a small amount of hardware. The distance between the pixels where the error is introduced and the pixels where this error is diffused is slightly larger. The error is preferably further diffused by subtracting a part of the error from the next-nearest neighbouring pair of lines, a smaller part from the next-nearest neighbouring pixel, etc.

$$df_{i+2,j}:=d_{i+2,j}-F_v*e_{i,j}-F''_v*e_{i-2,j}$$

$$df_{i+3,j}:=d_{i+3,j}-F'_v*e_{i+1,j}-F'''_v*e_{i-1,j}$$

CC: Two-dimensional feedback (1 sample delay and 2 lines delay), as shown in FIG. 4: part of the error is subtracted from the original pixel luminance values of the pixels located on the same pair of lines, one step further to the right, and part of the error is subtracted from the original pixel luminance values of the pixels located on a pair of lines, two steps further below, and on the same columns:

$$d_{i+2,j+1}:=d_{i+2,j+1}-F_h*e_{i+2,j}-F_v*e_{i,j+1}$$

$$d_{i+3,j+1}:=d_{i+3,j+1}-F'_h*e_{i+3,j}-F'_v*e_{i+1,j+1}$$

Figure 4:
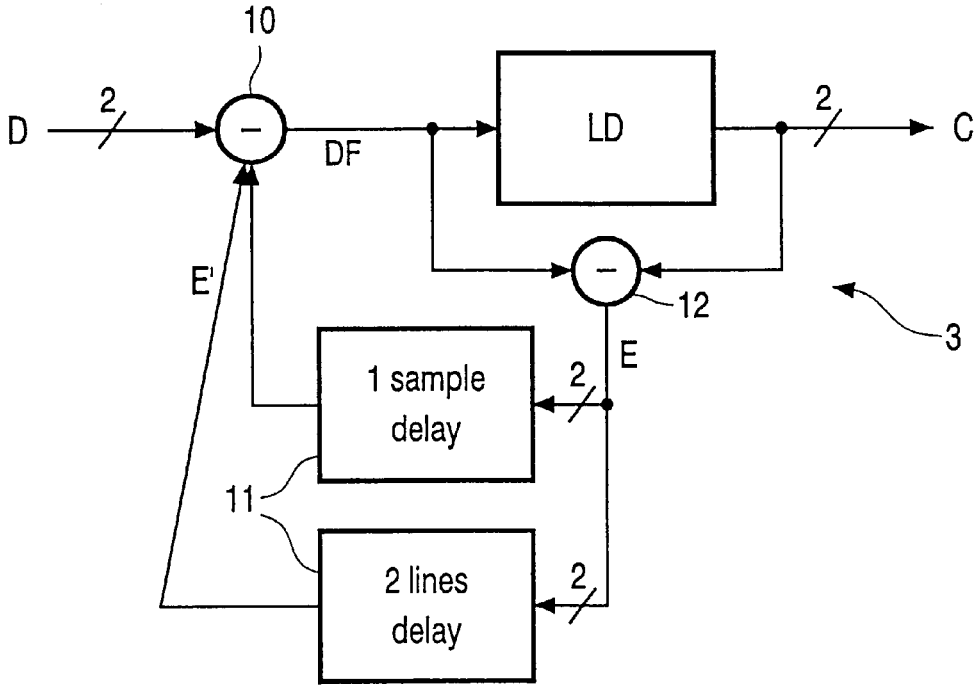
FIG. 4 is a detailed view of unit (3) of the invention, combining features of the first and second embodiment of the invention.

FIG. 4 shows a unit 3 for performing two-dimensional feedback. By combining horizontal and vertical feedback, better results can be achieved.

Again, diffusion of a part of the error may be subtracted from the next nearest neighbouring pixel or pair of lines and a smaller part from the next-nearest neighbouring pixel or pair of lines.

DD: Temporal feedback (1 frame delay), as shown in FIG. 5: the error $e_{ij}(t)$ and $e_{i+1,j}(t)$ for the frame displayed at time t, or part thereof, is subtracted from the original pixel luminance values $d_{i,j}(t+1)$, $d_{i,j}(t+1)$ of the same pixels of the subsequent frame, displayed at time t+1.

Figure 5:
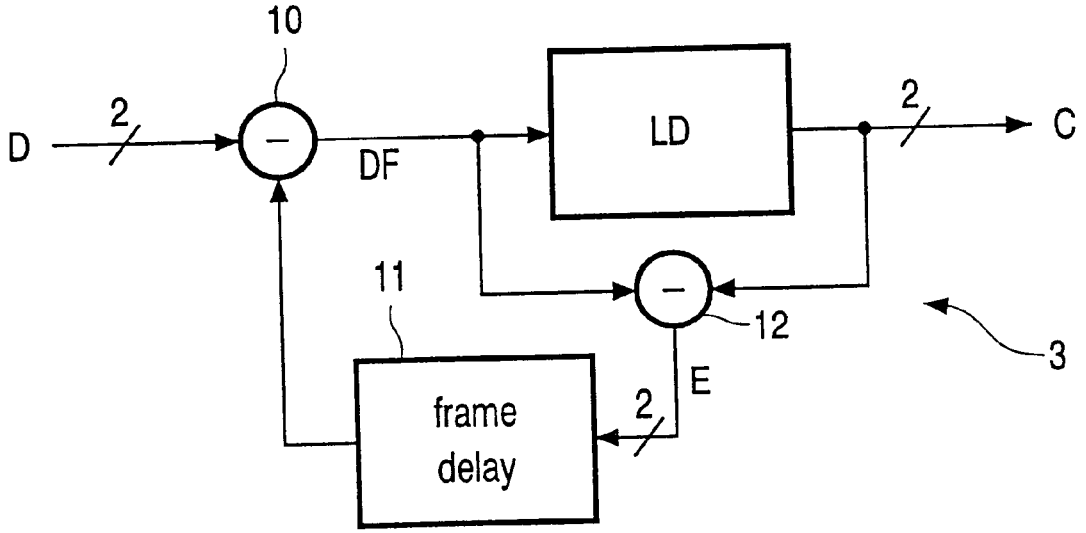
FIG. 5 is a detailed view of unit (3) of the invention, according to a third embodiment of the invention.

FIG. 5 shows a unit 3 for performing temporal feedback. The best results can be obtained by combining horizontal, vertical and temporal feedback.

Although the above embodiments relate to line doubling, the application to the grouping of three or more lines will be straightforward to those skilled in the art.

In the above, the sign := means that the element on the left of the sign is replaced by the value on the right. In FIGS. 2 to 5, the "/" and the number 2 near signal lines indicate that these are double lines.

The parameters $F_h$, $F_v$, $F'_h$, $F'_v$ etc, hereinafter also denoted as 'feedback coefficients' may be given any value found convenient by experience. It is advantageous to give these parameters the value 1 in the case of horizontal and vertical feedback, and values such that $F_h+F_v=1$, $F'_h+F'_v=1$ i.e. the sum of all feedback coefficient F for a particular error value $e_{i,j}$ is 1. In the case of two-dimensional feedback, this ensures that the total luminance of the picture is kept constant. By giving these feedback coefficients or the sum of these feedback coefficients values of less than 1, only part of the error is diffused.

The following table depicts schematically example values for feedback coefficients $F_h$, $F'_h$, . . . and $F_v$, $F'_v$, . . . in different embodiments.

Simple Horizontal feedback, see FIG. 2

| | Pixel | Nearest pixel | Next-nearest pixel | Next-next-nearest pixel |
|---|---|---|---|---|
| Same pair of lines | 0 | 1 | 0 | 0 |
| Nearest pair of lines | 0 | 0 | 0 | 0 |
| Next-nearest pair of lines | 0 | 0 | 0 | 0 |
| Next-next-nearest pair of lines | 0 | 0 | 0 | 0 |

In this example it thus holds $$df_{i,j+1}:=d_{i,j+1}-e_{i,j}$$

$$df_{i+1,j+1}:=d_{i+1,j+1}-e_{i+1,j}$$

This is an example of the subject of dependent claim 2, in its simplest form, i.e. the embodiment wherein the subtractor (10) subtracts, in operation, said differences $e_{ij}$, . . . $e_{i+g-1,j}$ or part thereof from the original luminance values $d_{i,j+1}$, . . . $d_{i+g-1,j+1}$ of pixels located on the next column j+1 and the same lines i, . . . i+g−1.

Horizontal feedback over more than one pixel

| | Pixel | Nearest pixel | Next-nearest pixel | Next-next-nearest pixel |
|---|---|---|---|---|
| Same pair of lines | 0 | 0.6 | 0.3 | 0.1 |
| Nearest pair of lines | 0 | 0 | 0 | 0 |
| Next-nearest pair of lines | 0 | 0 | 0 | 0 |
| Next-next-nearest pair of lines | 0 | 0 | 0 | 0 |

In this example it thus holds $$df_{i,j+1}:=d_{i,j+1}-0.6*e_{i,j}-0.3*e_{i-1,j}-0.3*e_{i-2,j}$$

$$df_{i+1,j+1}:=d_{i+1,j+1}-0.6*e_{i+1,j}-0.3*e_{i,j}-0.1*e_{i-1,j}$$

This is an example of the embodiment as claimed in claim 2 in a more general form, i.e. the subtractor (10) subtracts, in operation, said differences $e_{ij}$, . . . $e_{i+g-1,j}$ or part thereof from the original luminance values $d_{i,j+1}$, . . . $d_{i+g-1,j+1}$ of pixels located on the next column j+1 and/or a subsequent column j±2, j+3, (in this embodiment unit j+3) . . . and the same lines i, . . . i+g−1.

Instead of the coefficients 06, 0.3, 0.1, in practice, also the set of coefficients 9/16, 5/16, 1/8 appeared to yield good results.

Vertical feedback over one pair of lines, see FIG. 3

| | Pixel | Nearest pixel | Next-nearest pixel | Next-next-nearest pixel |
|---|---|---|---|---|
| Same pair of lines | 0 | 0 | 0 | 0 |
| Nearest pair of lines | 1 | 0 | 0 | 0 |
| Next-nearest pair of lines | 0 | 0 | 0 | 0 |
| Next-next-nearest pair of lines | 0 | 0 | 0 | 0 |

In this example it thus holds $$df_{i+2,j}:=d_{i+2,j}-e_{i,j}$$

$$df_{i+3,j}:=d_{i+3,j}-e_{i+1,j}$$

This is an example of the subject of dependent claim 3, in its simplest form, i.e. the embodiment wherein the subtractor (10) subtracts, in operation, said differences $e_{ij}$, . . . $e_{i+g-1,j}$ or part thereof from the original luminance values $d_{i+g,j}$, $d_{i+2g-1,j}$ of pixels located on the same column . . . and the nearest neighbouring lines i+g . . . i+2g−1, respectively.

Vertical feedback over more than one pair of lines

| | Pixel | Nearest pixel | Next-nearest pixel | Next-next-nearest pixel |
|---|---|---|---|---|
| Same pair of lines | 0 | 0 | 0 | 0 |
| Nearest pair of lines | 0.75 | 0 | 0 | 0 |
| Next-nearest pair of lines | 0.25 | 0 | 0 | 0 |
| Next-next-nearest pair of lines | 0 | 0 | 0 | 0 |

Simple two-dimensional feedback over one pixel and over one pair of lines, see FIG. 4

| | Pixel | Nearest pixel | Next-nearest pixel | Next-next-nearest pixel |
|---|---|---|---|---|
| Same pair of lines | 0 | 0.75 | 0 | 0 |
| Nearest pair of lines | 0.25 | 0 | 0 | 0 |
| Next-nearest pair of lines | 0 | 0 | 0 | 0 |
| Next-next-nearest pair of lines | 0 | 0 | 0 | 0 |

In this example it thus holds:

$$d_{i+2,j+1}:=d_{i+2,j+1}-0.75*e_{i+2,j}-0.25*e_{i,j+1}$$

$$d_{i+3,j+1}:=d_{i+3,j+1}-0.75*e_{i+3,j}-0.25*e_{i+1,j+1}$$

75% of the error is fed back to the next pixel in the horizontal direction and 25% to the pixels in the next pair of lines.

Two-dimensional feedback over more than one pixel and more than one pair of lines

| | Pixel | Nearest pixel | Next-nearest pixel | Next-next-nearest pixel |
|---|---|---|---|---|
| Same pair of lines | 0 | 0.45 | 0.15 | 0 |
| Nearest pair of lines | 0.20 | 0.15 | 0 | 0 |
| Next-nearest pair of lines | 0.05 | 0 | 0 | 0 |
| Next-next-nearest pair of lines | 0 | 0 | 0 | 0 |

In this example part of the error is diffused to a previous pixel (i.e. nearest to the pixel in question to the left-hand side) at the nearest pair of lines. This particular pixel is displayed after the pixel in question. In preferred embodiments the error is also diffused to the 'previous' pixel (i.e. seen in the direction in which the lines are written) on the nearest pair of lines. Instead of the coefficients 0.45, 0.10, 0.20, 0.05, in a practical application, also the coefficients 5/16, 1,8, 1/4, 1/16 appeared to yield good results.

In general, it is advantageous if the feedback coefficients $F_h$ and $F_v$ (or temporal feedback coefficients) diminish as the distance (in space or in time) increases. In all of the above tables, the total of all feedback coefficients for a particular error is 1 (one) which is a preferred embodiment. However, the total sum of the coefficient could deviate from 1 and could be smaller than 1, in which case only a part of the error is diffused.

Temporal feedback may also be effected over more than one frame, for instance 75% diffused to the next frame and the remaining 25% to the next-nearest frame.

A combination of temporal and spatial feedback may also be employed. When use is made of a combination of temporal and spatial feedback, the error may be and is preferably diffused not only to pixels immediately to the right of and below the pixel in question, but also to one or both of the pixels to the left of and above the pixel in question.

In embodiments, the feedback coefficients may be dependent on the magnitude of the error, wherein relatively small errors are diffused to nearest pixels and/or nearests pair of lines, (or not at all) whereas relatively large errors are diffused over a larger area. Preferably, the error diffusion coefficients are Y*(½"), for instance, ¾ and ¼, or multiples of 1/8 or 1/16 etc, the total sum of coefficients being preferably 1. A threshold for the diffusion coefficients may be chosen, below which threshold errors are no longer diffused.

While the invention has been described in connection with preferred embodiments, it will be understood that modifications thereof within the principles outlined above will be evident to those skilled in the art, and thus the invention is not limited to the preferred embodiments but is intended to encompass such modifications. More specifically, the preferred embodiments relate to line doubling, but the inventions is also applicable when more than two lines are grouped together. The preferred embodiments also relate to diffusion of the error to the nearest group of pixels, either to the right, or below, and/or to the same pixels in the subsequent frame. A diffusion of the error to further next-nearest pixels or beyond and/or to a subsequent frame may be performed within the framework of the invention. It is possible to interchange lines and columns.

The invention is applicable to display devices where the subfield mode is applied. The invention can be implemented by means of hardware comprising several distinct elements, and by means of a suitable programmed computer.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware.

The mere fact that certain measures are recited in mutually different dependent claims does not indicate that a combination of these measures cannot be used to advantage.

What is claimed is:

1. A matrix display device (1) comprising a display panel (5) having a set of lines ($r_1 \ldots r_i \ldots r_M$) of pixels, a data-processing unit (3) for receiving an input signal (D) representing successive frames comprising original line luminance values of pixels (D, $d_{i1} \ldots d_{ij} \ldots d_{iM}$), to determine new luminance values of the pixels (C; $c_{i1} \ldots c_{ij} \ldots c_{im}$) on the basis of the original line luminance values, the data-processing unit comprising a line-grouping means (LD), and a driver circuit (4) for supplying the new line luminance value data to said lines, said driver circuit (4) having means for addressing groups i . . . i+g−1 of g lines with the same values, characterized in that the data-processing unit (3) further comprises a subtractor (10) for subtracting a correction value signal (E') supplied by a processor unit (11) from the original line luminance values (D;$d_{11}, \ldots d_{ij} \ldots d_{MN}$) to supply difference values (DF; $df_{11}, \ldots df_{ij} \ldots df_{MN}$) to the line-grouping circuit (LD), an error determining circuit (12) for receiving the difference values (DF; $df_{11}, \ldots df_{ij} \ldots df_{MN}$) and said new luminance values of pixels (C; $c_{il} \ldots c_{ij} \ldots c_{iM}$) to supply an error signal (E) comprising a set ($e_{ij}, \ldots e_{i+g-1,j}$) of the differences between the new luminance values (C; $c_{ij}, \ldots c_{i+g-1,j}$) of pixel j of grouping adjacent lines i, . . . i+g−1 and the difference values $d_{ij}, \ldots d_{i+g-1,j}$ of pixel j of the same lines, and the processor unit (11), for receiving the error signal (E) to convert the error signal (E) into the correction value signal (E').

2. A matrix display device (1) as claimed in claim 1, characterized in that, in operation, the subtractor (10) subtracts said differences $e_{ij}, \ldots e_{i+g-1,j}$ or part thereof from the original luminance values $d_{i,j+1}, \ldots d_{i+g-1,j+1}$ of pixels located on the next column j+1 and the same lines i, . . . i+g−1, respectively.

3. A matrix display device (1) as claimed in claim 1, characterized in that, in operation, the subtractor (10) subtracts said differences $e_{ij}, \ldots e_{i+g-1,j}$ or part thereof from the original luminance values $d_{i+g,j}, d_{i+2g-1,j}$ of pixels located on the same column and/or neighbouring columns j−2, j−1, j+1, j+2 . . . and the neighbouring line and/or neighbouring lines i+g . . . i+2g−1, respectively.

4. A matrix display device (1) as claimed in claim 1, wherein frames are displayed subsequently, characterized in that, in operation, subtractor (10) subtracts said differences $e_{ij}, \ldots e_{i+g-1,j}$ or part thereof from the original luminance values $d_{i,j}, d_{i+g-1,j}$ of pixels located on the same column j and the same lines i . . . i+g−1 of the subsequent frame, respectively.

5. A matrix display device (1) as claimed in claim 1, wherein said luminance values are coded in subfields, said subfields consisting of a set of most significant subfields and a set of least significant subfields, said new luminance values having, for all or part of the least significant subfields, the same value for a group i, . . . i+g−1 of adjacent lines, and being addressed simultaneously to said group of lines.

6. A matrix display device (1) as claimed in claim 1, wherein said groups i . . . i+g−1 are pairs.

7. A method of determining new luminance values of the pixels (C; $c_{i1} \ldots c_{ij} \ldots c_{im}$) on the basis of original line luminance values (D, $d_{i1} \ldots d_{ij} \ldots d_{iM}$) to be displayed on a matrix display device (1) comprising a display panel (5) having a set of lines ($r_1 \ldots r_i \ldots r_M$) of pixels, the method comprising the step of data-processing to supply the new line luminance value data to said lines, and to address groups i . . . i+g−1 of g lines with the same values, characterized in that the method comprises:

subtracting (10) a correction value signal (E') from the original line luminance values (D;$d_{11}, \ldots d_{ij} \ldots d_{MN}$) to supply difference values (DF; $df_{11}, \ldots df_{ij} \ldots df_{MN}$), error-determining to supply (12) an error signal (E) comprising a set ($e_{ij}, \ldots e_{i+g-1,j}$) of the differences between the new luminance values (C; $c_{ij}, \ldots c_{i+g-1,j}$) of pixel j of grouping adjacent lines i, . . . i+g−1 and the difference values $d_{ij}, \ldots d_{i+g-1,j}$ of pixel j of the same lines, and processing (11) to convert the error signal (E) into the correction value signal (E').

8. A method as claimed in claim 7, wherein said differences $e_{ij}, e_{i+g-1,j}$ or part thereof are subtracted from the original luminance values $d_{i,j+1}, \ldots d_{i+g-1,j+1}$ of pixels located on the next column j+1 and the same lines i, . . . i+g−1, respectively.

9. A method as claimed in claim 7, wherein said differences $e_{ij}, \ldots e_{i+g-1,j}$ or part thereof are subtracted from the original luminance values $d_{i+g,j}, d_{i+2g-1,j}$ of pixels located on the same column j and lines i+g . . . i+2g−1, respectively.

10. A method as claimed in claim 7, wherein said differences $e_{ij}, \ldots e_{i+g-1,j}$ or part thereof are subtracted from the original luminance values $d_{ij}, d_{i+g-1,j}$ of pixels located on the same column j and the same lines i . . . i+g−1, of the subsequent frame, respectively.

11. A method as claimed in claim 7, wherein said luminance values are coded in subfields, said subfields consisting of a set of most significant subfields and a set of least significant subfields, said new luminance values having, for all or part of the least significant subfields, the same value for a group i, . . . i+g−1 of adjacent lines.

12. A method as claimed in claim 7, wherein said groups i . . . i+g−1 are pairs.

* * * * *